United States Patent [19]

Kondoh

[11] Patent Number: 4,601,258

[45] Date of Patent: Jul. 22, 1986

[54] ELECTROPHOTOGRAPHIC DEVELOPING DEVICE HAVING TONER REMOVING MEANS

[75] Inventor: Shiroh Kondoh, Sagamihara, Japan

[73] Assignee: Ricoh Company, Ltd., Japan

[21] Appl. No.: 653,940

[22] Filed: Sep. 24, 1984

[30] Foreign Application Priority Data

Sep. 22, 1983 [JP] Japan ..... 58-174321

[51] Int. Cl.[4] ..... G03G 15/09

[52] U.S. Cl. ..... 118/652; 118/657; 118/658

[58] Field of Search ..... 118/657, 658, 652

[56] References Cited

U.S. PATENT DOCUMENTS

| | | | |
|---|---|---|---|
| 3,882,823 | 5/1975 | Tanaka et al. | 118/652 |
| 3,955,533 | 5/1976 | Smith et al. | 118/652 |
| 4,226,524 | 10/1980 | Hashimoto | 118/657 X |
| 4,311,780 | 1/1982 | Mochizuki et al. | 118/652 X |

*Primary Examiner*—John D. Welsh

*Attorney, Agent, or Firm*—Guy W. Shoup

[57] ABSTRACT

A device for developing an electrostatic latent image carried on an image bearing member comprises a developing sleeve for transporting a magnetic developer as carried thereon through a developing station where the developer is applied to the image bearing member to develop the latent image thereon, a doctor blade for forming a developer film of predetermined thickness and charge, a plurality of magnets disposed inside of the developing sleeve to have the magnetic developer attracted to the developing sleeve, and a scraper for removing the developer remaining on the sleeve after development. In the preferred embodiment, the scraper is pivotally supported and at least comprised of a magnetic material thereby allowing it to be pressed against the sleeve due to magnetic attraction from the magnets inside of the sleeve. In addition, the scraper is provided with a surface-hardened portion at least at that section which comes into contact with the developer on the sleeve when the scraper is pressed against the sleeve.

10 Claims, 4 Drawing Figures

ELECTROPHOTOGRAPHIC DEVELOPING DEVICE HAVING TONER REMOVING MEANS

BACKGROUND OF THE INVENTION

1. Field of the Invention

This invention relates to a device for developing an electrostatic latent image formed on an image bearing member and in particular to a developing device using a single component or magnetic developer suitable for use in image processing machines, such as electrophotographic copiers, facsimile machines and printers.

2. Description of the Prior Art

FIG. 1 schematically illustrates a prior art developing device of the type in which a single component or magnetic developer is transported cyclically along a predetermined path thereby applying the developer to an image bearing member on which an image to be developed is carried. The developing device of FIG. 1 includes a developing sleeve 2 which is supported to be driven to rotate in the direction indicated by the arrow. Onto the peripheral surface of the sleeve 2 is supplied toner 1 from a hopper 3, and as the sleeve 2 rotates, the toner 1 supplied to the sleeve 2 is regulated in thickness by means of a doctor blade 4, which is disposed at the downstream side of the hopper 3, so that there is formed a thin layer of electrically charged toner on the sleeve 2. Then, as the sleeve 2 further rotates, the toner layer thus formed is brought to a developing station D where the sleeve 2 is in rolling contact with an imaging belt 5 on which an electrostatic latent image is carried. At the developing station, the toner is selectively transferred from the sleeve 2 to the belt 5 in accordance with the charge pattern defined by the latent image so that the latent image is developed into a visible image. Thus, the toner layer on the sleeve 2 after the developing station D is irregular in thickness.

The developing device of FIG. 1 also includes a scraper 6 as fixedly mounted on a wall defining part of the hopper 3 with its free end in sliding contact with the developing sleeve 2. Thus, the toner remaining on the sleeve 2 is once removed from the sleeve by the scraper 6 and the thus removed toner is transported into the hopper 3 as passing through holes 6*a* provided in the scraper 6 so that it comes to be mixed with the toner stored in the hopper 3. Then, with the rotation of the developing sleeve 2, the recovered toner is well mixed with the toner stored in the hopper 3 at a stagnation area S, whereby the toner of uniform quality is prepared to be supplied to the developing sleeve 2 for the subsequent developing cycles.

The scraper 6 is typically comprised of an elastic material and it is typically provided with its base end fixedly mounted, for example, on a housing of hopper 3 and its free end pressed against the developing sleeve 2 disposed in a counter direction with respect to the direction of transportion of the toner carried on the sleeve 2 at the point of contact between the sleeve 2 and the scraper 6. With such a scraper 6, when fluctuation occurs in the thickness of the toner film on the sleeve 2 and/or the level of frictional force at the contact between the sleeve 2 and the scraper 6, unstability is created in the scraping function. Difficulty also exists in manufacturing and mounting the scraper 6 accurately. Therefore, there has been a need to provide a developing device having an improved scraping performance.

SUMMARY OF THE INVENTION

It is therefore a primary object of the present invention to provide an improved developing device for use in an image processing machines, such as facsimile machines, electrophtographic copiers and printers.

Another object of the present invention is to provide an improved developing device for developing an electrostatic latent image formed on an image bearing member, such as a photosensitive member.

A further object of the present invention is to provide an improved developing device capable of providing a stable developing performance at all times.

A still further object of the present invention is to provide a developing device employing toner as a developer, which has an improved structure for removing unused toner from a developing sleeve.

Other objects, advantages and novel features of the present invention will become apparent from the following detailed description of the invention when considered in conjunction with the accompanying drawings.

DESCRIPTION OF THE PREFERRED EMBODIMENTS

Figure 1:
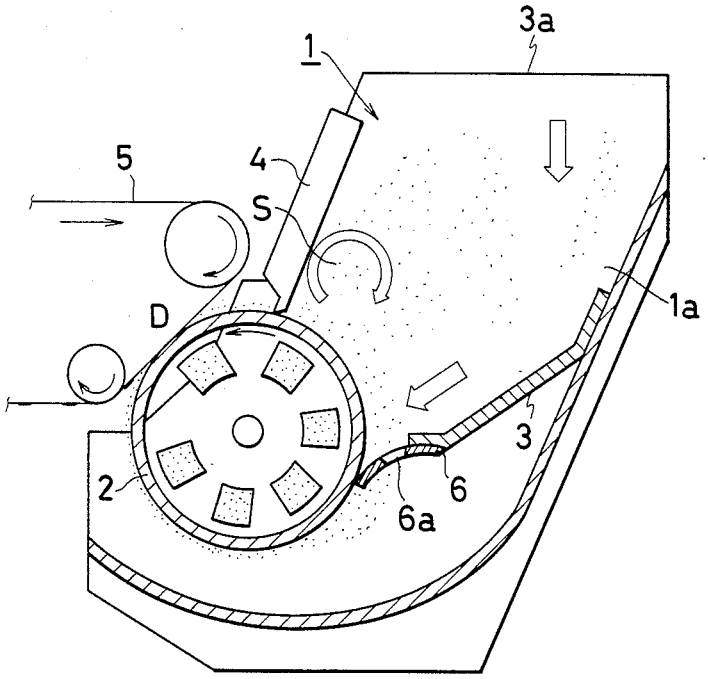
FIG.1 PRIOR ART
FIG. 1 is a schematic illustration showing a typical prior art developing device.
Figure 2:
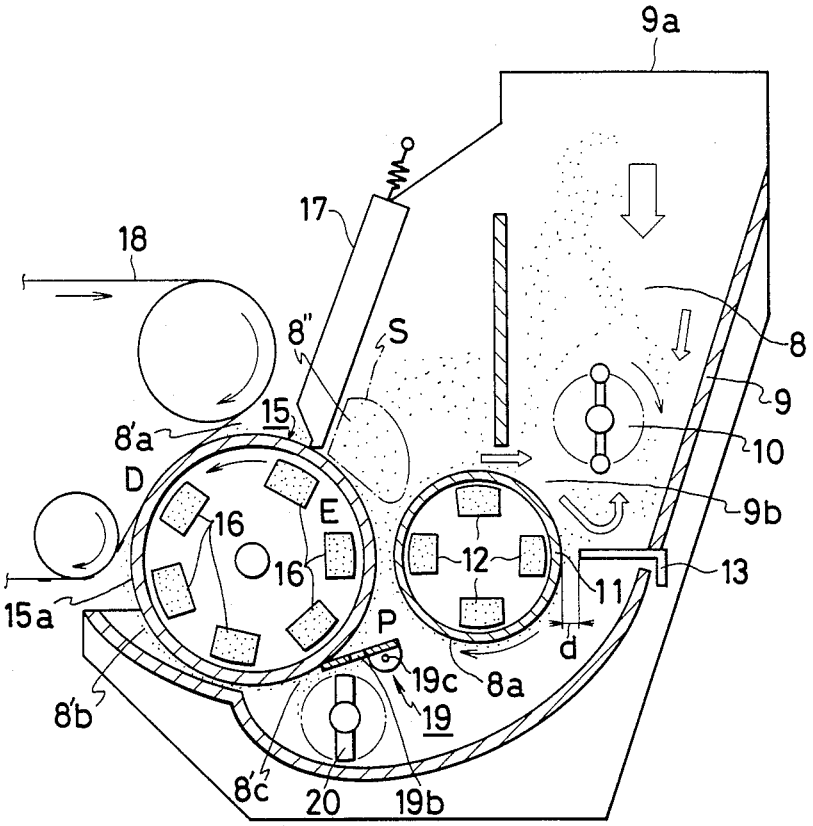
FIG. 2 is a schematic illustration showing the overall structure of a developing device using a single component toner constructed in accordance with one embodiment of the present invention.

Referring now to FIG. 2, there is shown a developing device constructed in accordance with one embodiment of the present invention when applied to a system of developing an electrostatic latent image with a single component or magnetic toner developer. As shown, the developing device includes a hopper 9 for containing therein a quantity of fresh magnetic toner 8 supplied through an opening 9*a*. Inside the hopper 9 is rotatably provided an agitator 10 for stirring the toner 8 supplied into the hopper 9, and below the agitator 10 is defined a supply opening 9*b* for supplying the fresh and well-mixed toner 8 to a supply sleeve 11, which is rotatably provided at the supply opening 9*b* of hopper 9.

A plurality of magnets 12 are disposed inside of the supply sleeve 11 so that the magnetic toner 8 freshly supplied from the hopper 9 is magnetically attracted to the peripheral surface of the supply sleeve 11. Also provided at the supply opening 9*b* of the hopper 9 is a first doctor blade 13 disposed radially with respect to the supply sleeve 11 with its base end fixedly mounted on a housing of the present developing device, which also defines part of the hopper 9, and its free end separated away from the supply sleeve 11 over a gap d, which is preferably in the order of 0.3 ±0.2 mm. Thus, the fresh toner 8 magnetically attracted to the supply sleeve 11 is regulated in thickness as the sleeve 11 rotates clockwise so that there is formed a thin layer 8*a* of fresh toner 8 on the supply sleeve 11. As the supply sleeve 11 further rotates, this toner thin layer 8a is transferred to a developing sleeve 15 which is disposed adjacent to the supply sleeve 11 with a predetermined distance, preferably in the range between 2 and 6 mm, therebetween. As also shown in FIG. 2, another plurality of magnets 16 are disposed inside of the developing sleeve 15, and, it is to be noted that arrangement and magnetic strength of some of these magnets 16 inside of the developing sleeve 15 and the magnets 12 inside of the supply sleeve 11 are determined such that the toner layer 8a may be effectively transferred from the supply sleeve 11 to the developing sleeve 15 magnetically as flying over the gap therebetween.

The toner thus transferred to the developing sleeve 15 is then transported as carried thereon to come to a toner stagnation area S, which is generally defined in front of a second doctor blade 17, as the developing sleeve 15 is driven to rotate counterclockwise. In the peripheral surface of the developing roller 15 is provided an electrically conductive silicon rubber layer 15a having resistivity of $10^5$ ohms.cm or less. The second doctor blade 17 is provided generally radially with respect to the developing sleeve 15 as slidably supported on the housing of the developing device 15. The second doctor blade 17 is spring biased such that its free end is pressed against the peripheral surface of the developing sleeve 15 defined by the silicon rubber layer 5a. As a result, as the developing sleeve 15 rotates counterclockwise, there is formed a thin layer 8a' of toner.

As also shown in FIG. 2, the present developing device is disposed such that the developing sleeve 15 is in rolling contact with an endless image bearing belt 18 which is extended around a plurality of rollers. Although not shown, it should be understood that an electrostatic latent image is formed on the belt 18 by any image forming means well known for one skilled in the art and such an electrostatic latent image is brought to a developing station D, which is defined as a region where the belt 18 comes closer to the developing sleeve 15, as the belt 18 advances as indicated by the arrow. At the developing station D, the thin toner layer 8a' is selectively transferred to the belt 18 according to the charge pattern defined by a latent image to be developed whereby the latent image on the belt 18 is developed into a visible image. It is to be noted that the developing sleeve 15 may be in rolling contact with, as shown in FIG. 2, or separated away from the surface of the belt 18 over a predetermined distance at the developing station D.

Also provided in the developing device of FIG. 2 is a scraper 19 at a location downstream of the developing station D with respect to the direction of transportion of the toner carried on the developing sleeve 15. Thus, after development, there is formed a remaining toner layer 8b' on the developing sleeve 15, which is removed from the developing sleeve 15 by means of the scraper 19. In the illustrated embodiment, the scraper 19 is comprised of a thin plate of magnetic material and it is pivotally supported at a pivot 19c so that the thin plate scraper 19 has its free end pressed against the developing sleeve 15 as magnetically attracted thereto by means of the magnets 16 disposed inside of the developing sleeve 15. Such a structure is advantageous in obtaining uniform pressure force along the entire contact line between the sleeve 15 and the scraper 19 and the level of contact pressure may be maintained at constant virtually under any condition.

Figure 3:
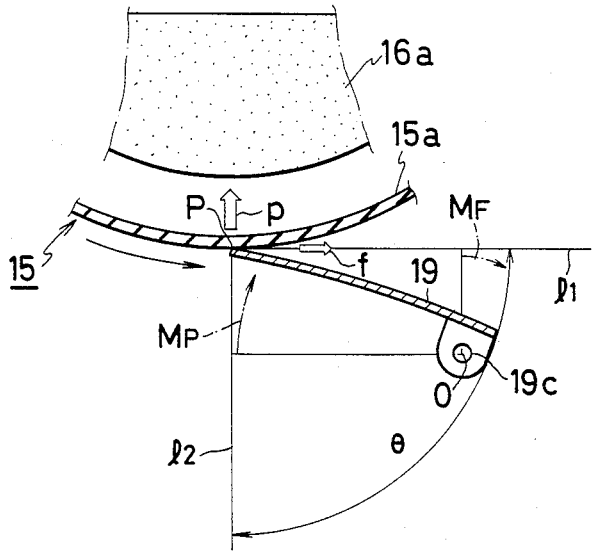
FIG. 3 is a schematic illustration showing the arrangement of the scraper 19 with respect to the developing sleeve 15 according to the principle of the present invention.

As more clearly shown in FIG. 3, in accordance with the principle of the present invention, the position of the pivot 19c is determined such that it is located at the downstream side from a contact line P between the developing sleeve 15 and the scraper 19 with respect to the direction of movement of the sleeve 15 thereat and yet it is located in a region defined between an imaginary tangential line $1_1$ extending from the contact line P and an imaginary normal line $1_2$ extending from the contact line P. The angle $\theta$ formed between these tangential and normal lines $1_1$ and $1_2$ is surely 90°. If the scraper 19 is provided with its pivot 19c so located as described above, a moment $M_p$ acting on the scraper 19 due to a magnetic attractive force p by the magnet 16a around the center O of pivot 19c is clockwise around the pivot center O. Moreover, another moment $M_F$ acting on the scraper 19 due to a frictional force between the developing sleeve 15 and the scraper 19 is also clockwise around the pivot center O. Thus, the total moment $M_T$, which is an algebraic sum of $M_p$ and $M_F$, acts on the scraper 19 clockwise around the pivot center O, thereby allowing to secure an intended pressure contact condition between the developing sleeve 15 and the scraper 19. In other words, even if fluctuations are present in the frictional force f between the developing sleeve 15 and the scraper 19 and/or in the thickness of the remaining toner layer 8b', the scraper 19 can be maintained as properly pressed against the developing sleeve 15 to remove the remaining toner layer 8b' therefrom stably. It is to be noted that since the scraper 19 is provided as pivotally supported, its manufacturing tolerances may be significantly relaxed and its mounting accuracy may also be greatly relaxed.

It is to be noted, however, that the moment $M_F$ resulting from the frictional force f depends on the shape of free end portion of the scraper 19, which is brought into pressure contact with the developing sleeve 15, and in particular on the surface property of the free end portion. That is, if the free end portion of the scraper 19 becomes rounded due to friction with the toner layer on the developing sleeve 15, moment $M_F$ decreases significantly so that the contact pressure decreases thereby deteriorating the scraping performance. Such an effect is particularly appreciable when use is made of single component magnetic toner which is typically comprised of $Fe_3O_4$ as magnetic powder and $SiO_2$ as an additive. The scraper 19, typically comprised of a magnetic metal material, may be easily worn when scrubbed against such toner. That is, if the scraper 19 is made from an ordinary magnetic metal material, its hardness is typically in the range between Hv 500 and 600 so that its free end portion in sliding contact with the toner on the developing sleeve 15 may be easily worn.

Figure 4:
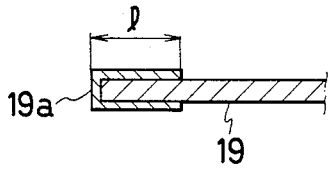
FIG. 4 is a partial cross-sectional view showing the structure of the scraper 19 according to another embodiment of the present invention.

According to the preferred embodiment of the present invention, the scraper 19 has its free end portion subjected to a surface hardening process to be provided with a high hardness film 19a, as shown in FIG. 4. The film 19a of high hardness in the illustrated embodiment is provided extending over a sufficient length 1 from its tip end toward its pivotal end such that only the high hardness film 19a is brought into contact with the toner on the developing sleeve 15 when the scraper 19 is pressed against the developing sleeve 15. In the illustrated embodiment, the high hardness film 19a is provided to enclose the tip end portion of the scraper 19 so that the mechanical integrity of the high hardness film 19a with the scraper 19 is significantly enhanced. However, as an alternative structure, it is also possible to provide such a high hardness film 19*a* only at that portion of the scraper 19 which is brought into pressure contact with the toner on the developing sleeve 15.

Various surface hardening methods may be applied to provide the high hardness film 19*a* and the preferred methods include ion nitriding, soft nitriding and ion plating. It is preferable to set the hardness of the high hardness film 19*a* in consideration of the contents of the toner used; for example, in the case of the present single component magnetic toner comprising $SiO_2$, it is preferable to set the hardness of the film 19*a* at Hv 1,000 or more.

Returning to FIG. 2, the developing device of the present invention is also provided with a scraper roller 20 as disposed in front of the scraper 19 and adjacent to the contact line between the developing sleeve 15 and the scraper 19. The scraper roller 20 is driven to rotate to have the toner 8*c*′ scraped off the developing sleeve 15 by the scraper 19 transported toward the downstream direction as passing through windows 19*b* formed in the scraper 19. The toner transported as passing through the windows 19*a* then moves into the stagnation area S where the thus recovered toner is mixed with the freshly supplied toner from the supply sleeve 11 so that there is produced mixed toner 8″ which is being prepared to be used for the subsequent developing operations. It is to be noted that the toner film 8*a*′ to be used for development is always formed from the mixture toner 8″ which is a mixture of recovered toner 8*c*′ and freshly supplied toner 8*a*, and, thus, the toner film 8*a*′ may be maintained constant in charge level as well as in concentration, which, in turn, allows to maintain the developing performance at constant.

While the above provides a full and complete disclosure of the preferred embodiments of the present invention, various modifications, alternate constructions and equivalents may be employed without departing from the true spirit and scope of the invention. For example, the present invention is also applicable for developing a magnetic latent image instead of an electrostatic latent image. Moreover, the developer to be used should not be limited to a single component developer, and the present invention may be equally applied to the case in which the conventional dual component developer is used. Thus, the above description and illustration should not be construed as limiting the scope of the invention, which is defined by the appended claims.

What is claimed is:

1. A device for developing a latent image formed on an image bearing member by applying a developer thereto as a developing station, comprising:

first transporting means for transporting said developer as carried thereon along a predetermined path including said developing station;

first attracting means for attracting said developer to said first transporting means, said first attracting means producing a magnetic field;

first film forming means disposed upstream of said developing station with respect to the direction of transportation of said toner for forming a film of said developer having a predetermined thickness and charge, said film of developer being applied to said image bearing member at said developing station for development of said latent image; and removing means disposed downstream of said developing station with respect to the direction of transportation of said toner for removing the developer remaining on said first transporting means after development at said developing station, said removing means being pivotally supported and normally pressed against said first transportion means as magnetically attracted by said attracting means.

2. The device of claim 1 further comprising:

storing means for storing a quantity of said developer, said storing means having a supply port;

second transporting means for transporting said developer as carried thereon along a predetermined cyclic path including a transfer station where said developer on said second transporting means is transferred to said first transporting means at least partly;

second attracting means for attracting said developer in said storing means to said second transporting means; and second film forming means provided at said supply port of said storing means for forming a film of said developer having a predetermined thickness and charge on said second transporting means.

3. The device of claim 2 wherein said developer is magnetically attractable toner and said first and second attracting means includes magnets.

4. The device of claim 3 wherein said first and second transporting means includes first and second sleeves each of which is rotatably supported and driven to rotate at constant speed.

5. The device of claim 4 wherein said removing means comprises a plate-shaped scraper which is composed of a magnetic material at least partly and pivotally supported at one end, said scraper having a free end which is pressed against said first sleeve due to magnetic attraction.

6. The device of claim 5 wherein a pivotal supporting point of said scraper is located downstream of the contact point between said first sleeve and said scraper and in a region defined between imaginary tangential and normal lines extending from the contact point between said first sleeve and said scraper.

7. The device of claim 6 wherein said scraper is provided with a surface-hardened portion at least at that section which comes into contact with said developer on said first sleeve when pressed thereagainst.

8. The device of claim 7 wherein said surface-hardened portion has hardness of Hv 1,000 or more.

9. The device of claim 8 wherein said surface-hardened portion is provided to enclose the free end of said scraper.

10. The device of claim 8 wherein said scraper is provided with a plurality of windows and said removing means further includes a roller rotatably disposed upstream of said scraper with respect to the direction of transportation of said developer and adjacent to the contact point between said first sleeve and said scraper for moving said developer removed from said first sleeve by said scraper toward the downstream direction through said windows.

* * * * *